US006109831A

United States Patent [19]

Handford

[11] Patent Number: 6,109,831

[45] **Date of Patent: *Aug. 29, 2000**

[54] UNDERGROUND BORING AND PIPE INSTALLATION

[75] Inventor: Reginald G. Handford, Calgary, Canada

[73] Assignee: Trenchless Replacement Services Ltd., Calgary, Canada

[ * ] Notice: This patent is subject to a terminal disclaimer.

[21] Appl. No.: 08/371,072

[22] Filed: Jan. 10, 1995

[51] Int. Cl.[7] ..... F16L 1/028; E21B 7/02; E21B 3/02

[52] U.S. Cl. ..... 405/184; 175/53; 175/62; 175/122; 175/162

[58] Field of Search ..... 405/184, 154; 175/62, 53, 122, 162, 171

[56] References Cited

U.S. PATENT DOCUMENTS

| | | | |
|---|---|---|---|
| 1,596,848 | 8/1926 | Mangnall | 175/53 X |
| 3,107,741 | 10/1963 | Adams et al. | 405/184 |
| 3,356,167 | 12/1967 | Trent | 405/184 |
| 3,482,641 | 12/1969 | Atkins et al. | 175/53 X |
| 4,020,641 | 5/1977 | Takada | 405/184 |
| 5,205,671 | 4/1993 | Handford | 405/154 |
| 5,340,238 | 8/1994 | Tuma | 405/184 |
| 5,427,475 | 6/1995 | Coss | 405/184 |

FOREIGN PATENT DOCUMENTS

| | | | |
|---|---|---|---|
| 2343079 | 4/1974 | Germany | 175/53 |
| 288195 | 3/1991 | Germany | 405/184 |

*Primary Examiner*—Hoang C. Dang

[57] ABSTRACT

A utility power unit (10) for underground drilling and pipe laying operations comprises a stationary frame portion (12), a movable frame portion (14) capable of performing sliding movement relative to the stationary frame portion (12) and hydraulic cylinders (44) between the stationary and the movable frame portions (12, 14) for effecting the relative movement. The movable frame portion (14) includes an attachment (36) for removably attaching a tool connecting member (38) thereto and a further attachment (40) for removably attaching a rotary drive unit (52) thereto. The invention also provides a method of directional boring along an intended underground path (62) comprising the steps of providing a machine pit (60) at a location along the intended path (62) and drilling a bore along the intended path (62) by means of directional drilling apparatus (10) which includes a stem (30) provided with a drill (68) at a forward end thereof. The bore is started from an inside wall (64) of the pit (60) and at a location beneath ground surface.

13 Claims, 11 Drawing Sheets

UNDERGROUND BORING AND PIPE INSTALLATION

FIELD OF THE INVENTION

This invention relates to a method of directional boring along an intended underground path. The invention also relates to apparatus for underground boring and pipe installation.

BACKGROUND OF THE INVENTION

Drilling with conventional directional boring machines is effected by boring into the ground at an angle until the intended depth is reached and then changing to a horizontal boring direction. This method by which a drill rod is launched from above the ground results in difficulties. Depending upon the prevailing soil conditions, the rod may follow any one of different paths resulting in problems with tracking the rod and steering accuracy. In some instances, it may even be necessary to excavate a pit to determine the position of the rod or whether or not a connection with an existing line is being made. In addition, the pulling power of such machines for pipe installation is limited and a separate machine with a stronger pulling force is required when larger diameter pipes are to be laid.

It is accordingly an object of the present invention to provide a directional boring method and boring and pipe installation apparatus which alleviates the above-mentioned difficulties.

SUMMARY OF THE INVENTION

According to the invention, there is provided a utility power unit for performing underground drilling and pipe laying operations, comprising a stationary frame portion; a movable frame portion capable of performing sliding movement relative to said stationary frame portion between a pair of limiting positions; hydraulic cylinder means between said stationary and said movable frame portions for effecting movement of said movable frame portion between said limiting positions; tool connection means associated with the movable frame portion and including first attachment means on the movable frame portion for removably attaching the tool connection means to the movable frame portion; and a rotary drive unit for an underground boring device associated with the movable frame portion and including second attachment means on the movable frame portion for removably attaching the rotary drive unit to the movable frame portion.

The movable frame portion may have a secondary portion movable relative to the movable frame portion, the second attachment means being located on the secondary portion. The unit may also include hydraulic cylinder means between the movable frame portion and the secondary portion for effecting movement of the secondary portion relative to the movable frame portion.

The unit may further comprise gripping and rotating means associated with the movable frame portion for gripping and rotating a stem to effect assembly of the stem from individual screw-threaded stem portions or disassembly of the stem into individual stem portions and third attachment means on the movable frame portion for removably attaching the gripping and rotating means to the movable frame portion.

The unit may also include stem locking means on the stationary frame portion for locking a stem against rotation about the longitudinal axis of the stem for the assembly or disassembly of stem portions.

The stationary frame portion may further have a front plate which is provided with a stem wiper plate for receiving a stem therethrough and including means on the wiper plate for wiping dirt or debris from the stem during longitudinal movement of the stem through the wiper plate.

Also according to the invention, there is provided a method of directional boring along an intended underground path, comprising the steps of providing a machine pit at a location along the intended path; drilling a bore along said intended path by means of directional drilling means which includes a stem provided with a drill bit at a forward end thereof, said bore starting from an inside wall of said pit at a location beneath ground surface.

The method may further comprise the steps of providing a pipe insertion pit along said intended path remote from said machine pit; drilling said bore up to said pipe insertion pit and through an inside wall of said pipe insertion pit; replacing said drill bit with a pipe insertion tool on the end of said stem; attaching a pipe to said pipe insertion tool; and pulling said pipe insertion tool and said pipe from said pipe insertion pit to said machine pit. In addition, the method may comprise the steps of replacing the pipe insertion tool with a drill bit on the end of said stem; drilling a bore in an opposite direction along said intended path, said bore starting from an opposite inside wall of said machine pit; providing a second pipe insertion pit along said intended path remote from said machine pit; drilling said opposite bore up to said second pipe insertion pit and through an inside wall of said second pit; replacing said drill bit with a pipe insertion tool on the end of said stem; attaching a second pipe to said pipe insertion tool; pulling said pipe insertion tool and said second pipe from said second pit to said machine pit; and connecting the ends of said pipe and said second pipe by means of a third pipe extending between the opposite walls of the machine pit.

Further objects and advantages of the invention will become apparent from the description of a preferred embodiment of the invention below.

DETAILED DESCRIPTION OF PREFERRED EMBODIMENT

Figure 1A:
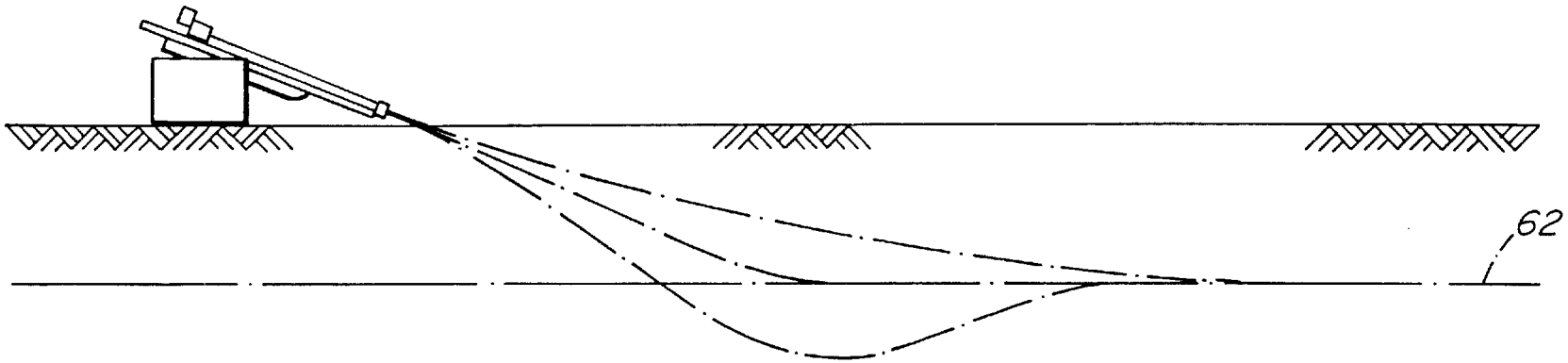
FIG. 1A PRIOR ART
FIGS. 1A and B are, respectively, side and plan views of a conventional boring machine performing a conventional directional boring operation.
Figure 1B:
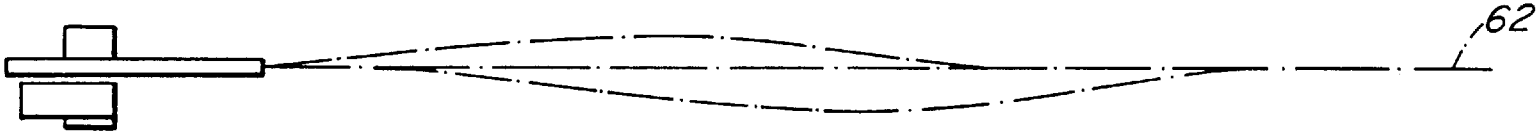
FIG. 1B PRIOR ART
Figure 2:
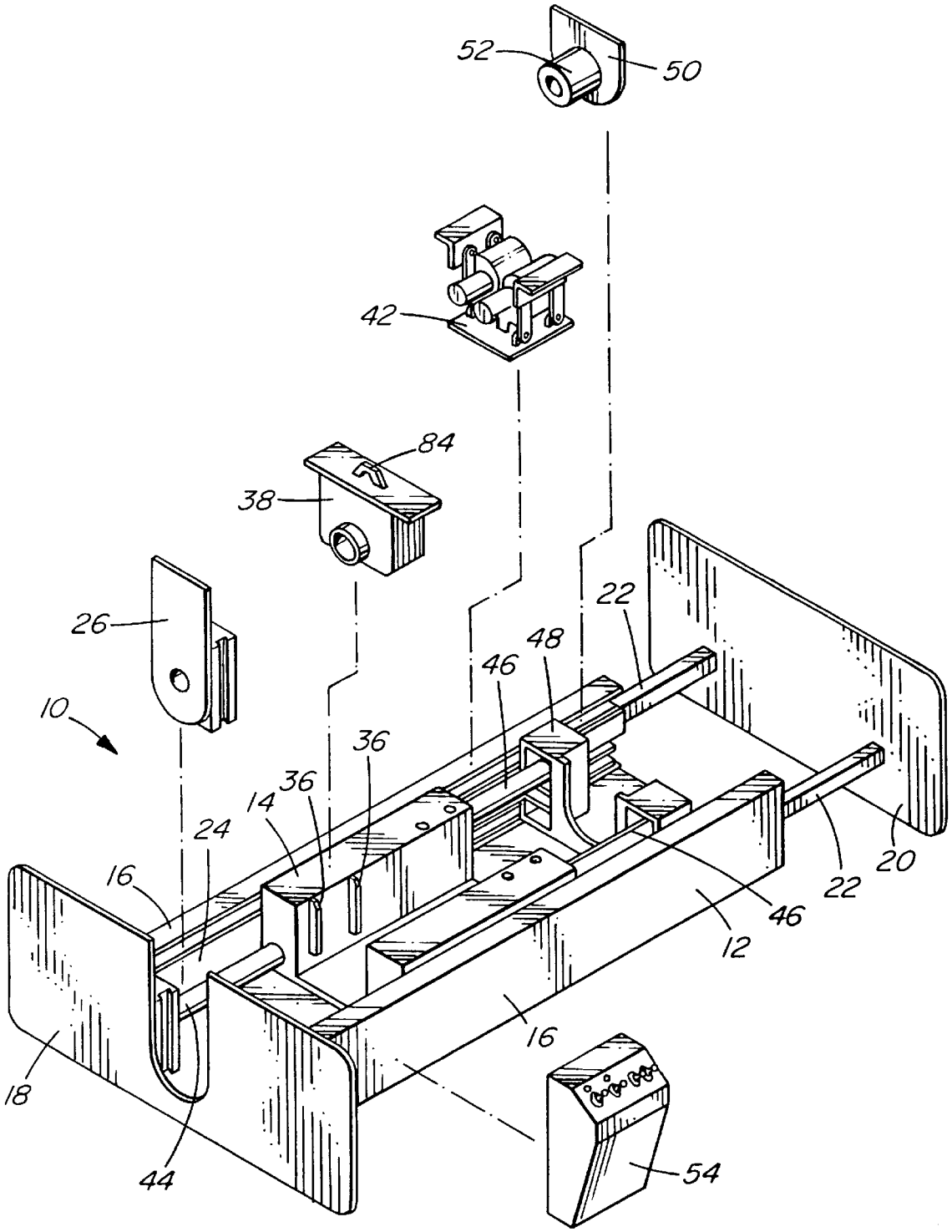
FIG. 2 is an exploded view of a directional boring apparatus according to the invention, which apparatus is convertible into an hydraulic unit for use with pipe replacement tools.

Referring to FIG. 2, reference numeral 10 generally indicates a hydraulic unit comprising a stationary frame portion or a main frame 12 and a moving frame portion or travelling carriage 14.

Figure 13:
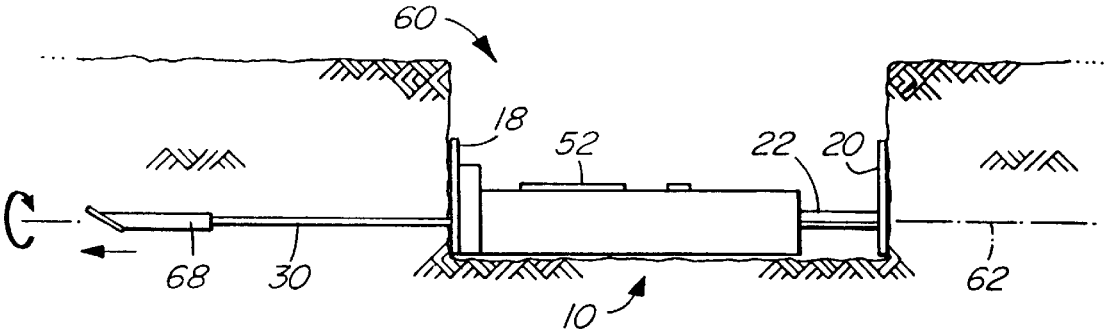
FIGS. 13–18 show various stages of a directional boring and pipe installation method being carried out by the apparatus of FIG. 2.

The main frame 12 comprises a pair of side members 16, a front plate 18 and a rear plate 20. The rear plate 20 is mounted on a pair of extension arms 22 which are movable relative to the rest of the main frame 12 so that the unit 10 can be wedged in between the opposite walls of a machine pit with the front plate 18 against one wall and the rear plate 20 pressed against the opposite wall of the pit, as shown in FIG. 13. The arms 22 are provided with a locking mechanism (not shown) for locking the rear plate 20 in position.

Figure 7A:
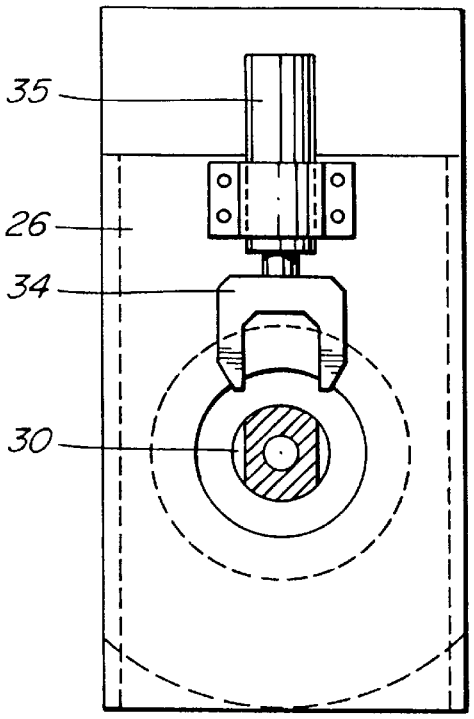
FIGS. 7A, B and C are, respectively, front, top and sectional side views of a wiper plate of the apparatus of FIG. 2.
Figure 7C:
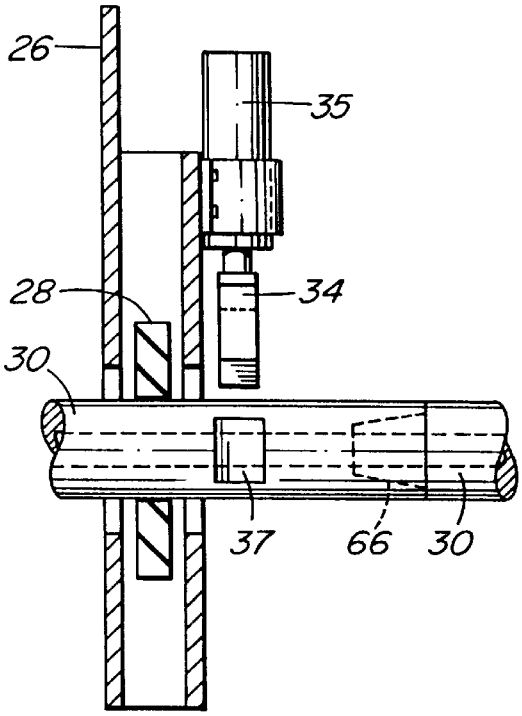
Figure 7B:
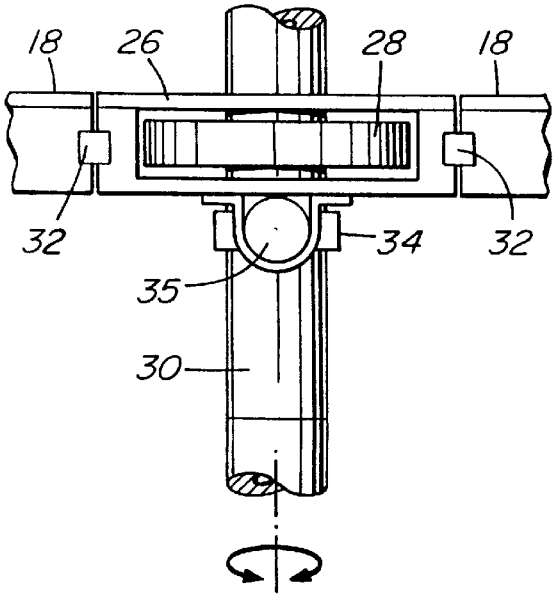
Figure 8:
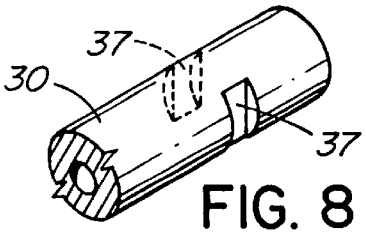
FIG. 8 is a three-dimensional, fractional view of a connection rod for use with the apparatus of FIG. 2.
Figure 9:
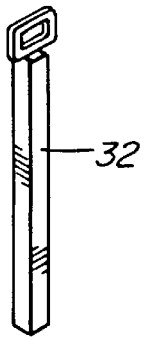
FIG. 9 is a three-dimensional view of a square locking key for the wiper plate of FIG. 7.

The front plate 18 is provided with a recess 24 for receiving a wiper plate 26 therein. The wiper plate 26 contains an annular rubber member 28 for receiving a drive rod 30 therethrough, as shown in FIGS. 7B and C. The function of the rubber member 28 is to wipe the rod 30 clean as it is pulled through the member 28 during operation. A pair of square keys 32 (FIG. 9) are provided for engaging the plate 26 with the front plate 18.

The wiper plate 26 further includes a rod engaging member in the form of a fork 34 for locking a rod 30 against rotation during assembly and disassembly of the rods 30. The fork 34 is operated by a hydraulic actuator 35 which raises or lowers the fork 34. When in the raised position, as shown in FIG. 7A, the fork 34 is in the open position in which a rod 30 is not engaged. In the lowered position, the fork 34 is engaged with a pair of mating notches or recesses 37 on opposite sides of the rod 30. Engagement with the recesses 37 locks the rod 30 against rotation about its longitudinal axis for the assembly or disassembly of rods 30, as will be described below.

The travelling carriage 14 is provided with a pair of guides 36 on each side for receiving tool connection means in the form of a slip bowl assembly 38. The carriage 14 is further provided with a pair of bolt holes 40 on either side for the attachment of a spinner assembly 42.

Figure 10:
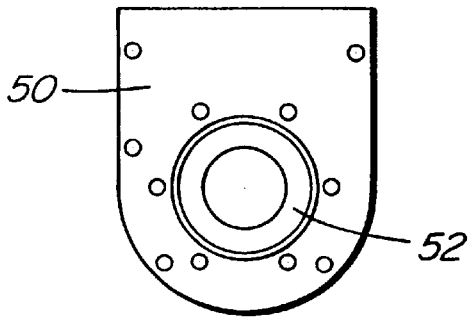
FIG. 10 is a front view of a drive unit mounting assembly of the apparatus of FIG. 2.
Figure 11:
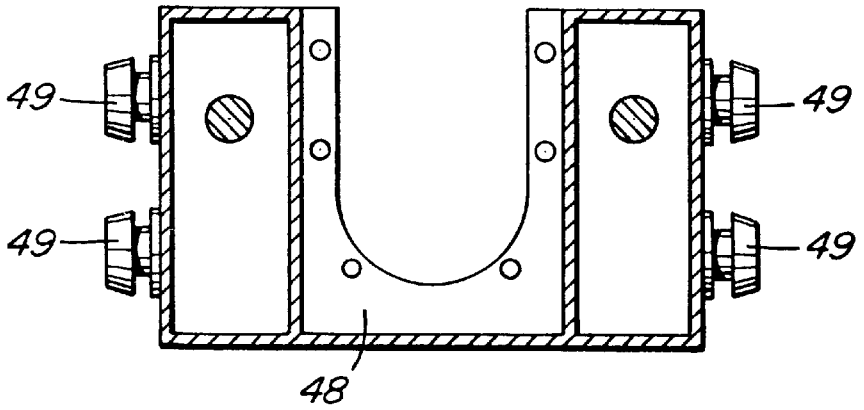
FIG. 11 is a cross-section through a drive unit mounting plate on the travelling carriage of the apparatus of FIG. 2.
Figure 12:
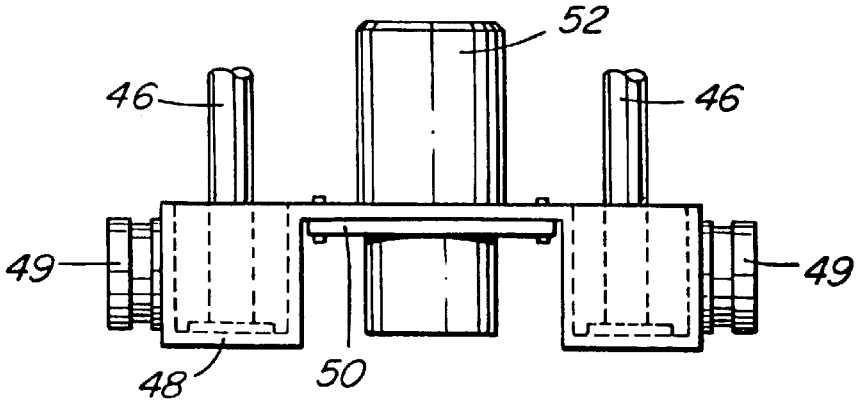
FIG. 12 is a fractional top view of the travelling carriage showing a drive unit mounted thereon.

A first pair of hydraulic cylinders 44 are provided between the carriage 14 and the front plate 18 for moving the carriage 14 relative to the front plate 18. A second pair of hydraulic cylinders 46 are provided between the opposite end of the carriage 14 and a travelling drive unit mounting plate 48 for movement of the plate 48 relative to the carriage 14. A drive unit mounting assembly 50 with a drive unit 52 such as a hydraulic motor, mounted thereon, is provided for attachment to the plate 48, as shown in FIGS. 10 to 12.

The travelling carriage 14 and the travelling drive unit mounting plate are both provided with travelling guides 49 which are guided along guide rails 51 povided on the side members 16 of the main frame 12.

In addition, the unit 10 includes a control panel 54 which is removable for set up above a machine pit during a directional boring operation.

Figure 3:
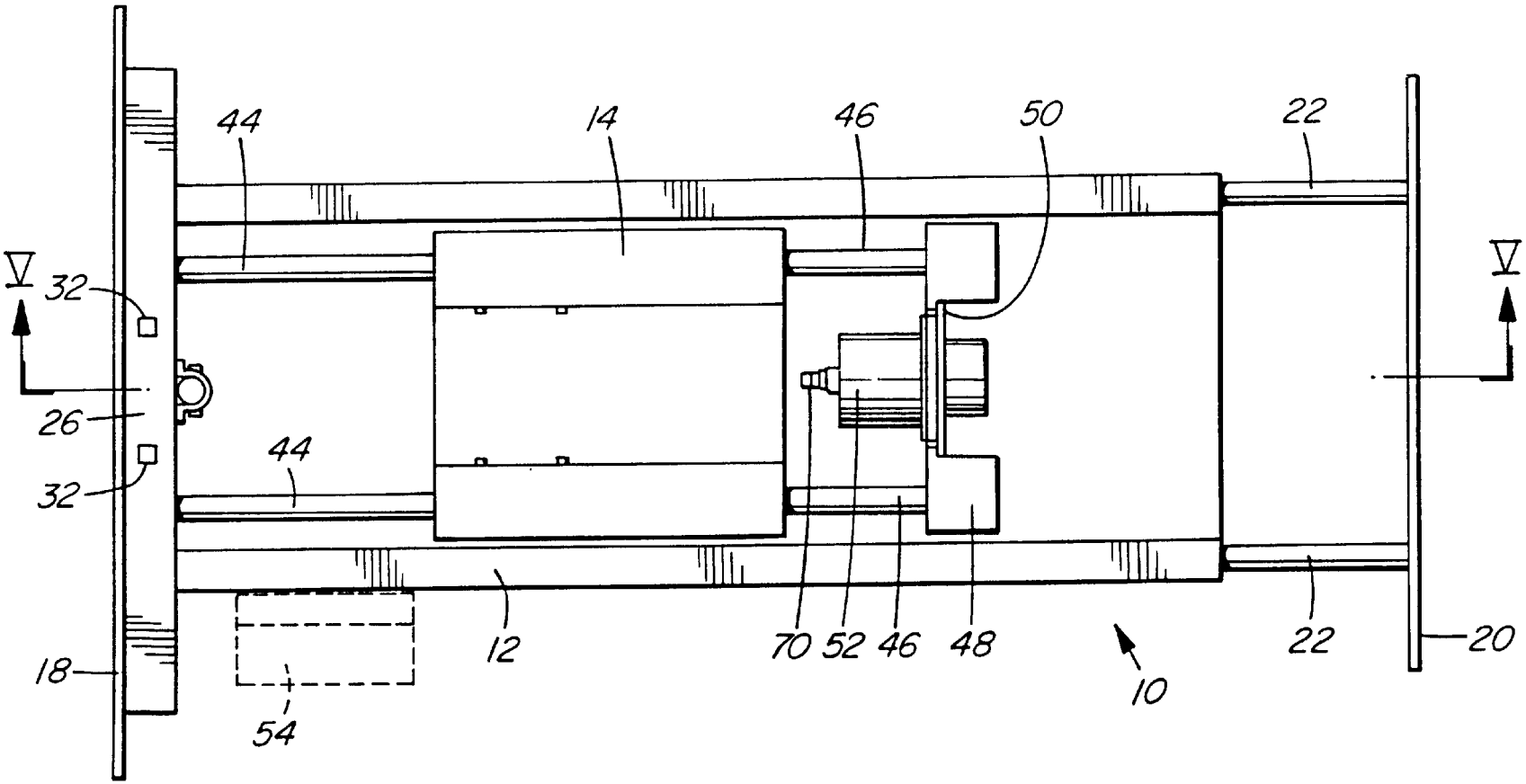
FIG. 3 is a plan view of the apparatus of FIG. 2 in a directional boring mode.

When the unit 10 is used in a directional boring operation, the slip bowl assembly 38 and the spinner assembly 42 are removed and the drive unit assembly 50 with the motor 52 are in place, as shown in FIG. 3.

Figure 4:
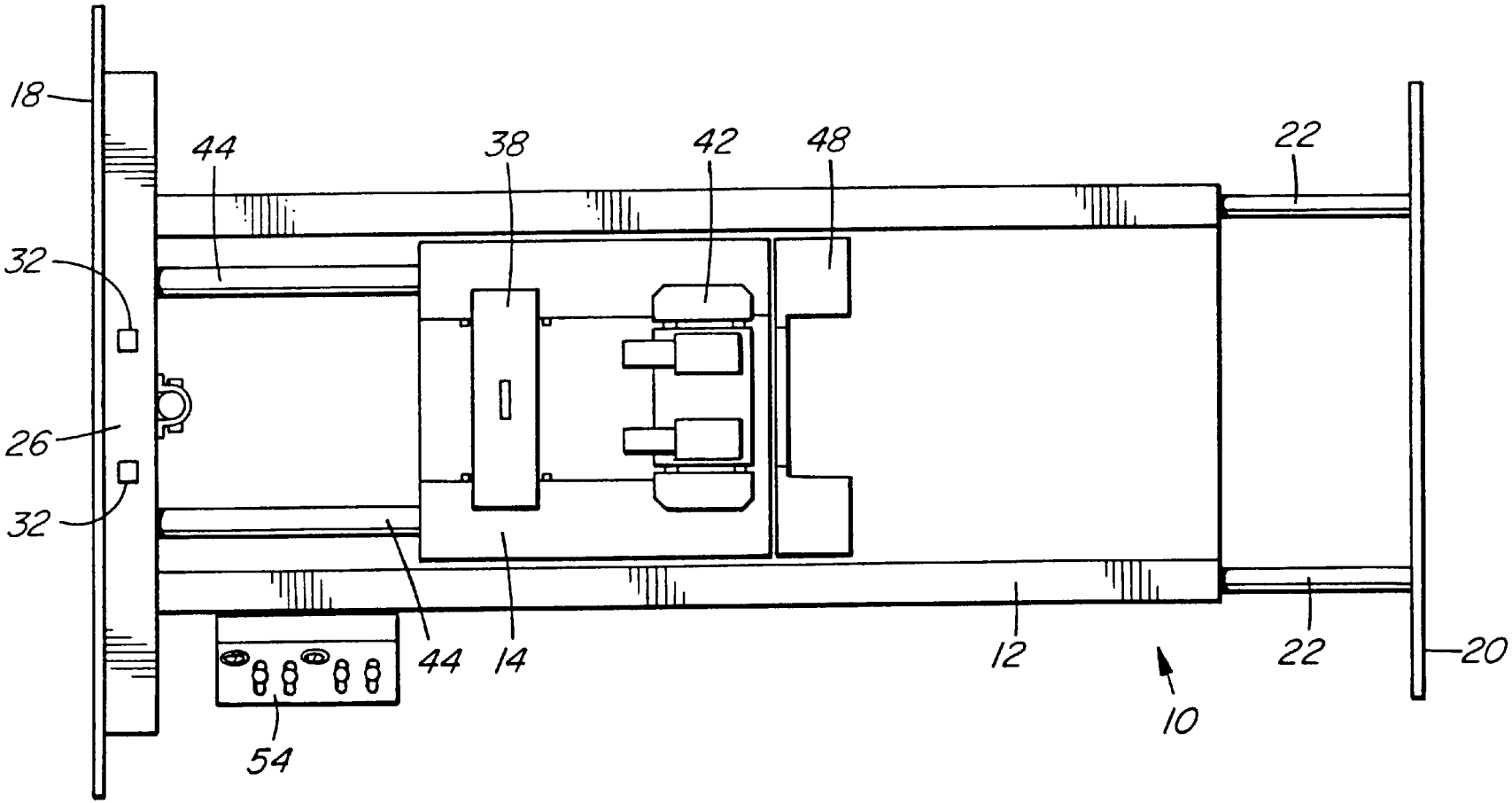
FIG. 4 is a plan view of the apparatus of FIG. 2 in a pipe replacement or pipe insertion mode.
Figure 5:
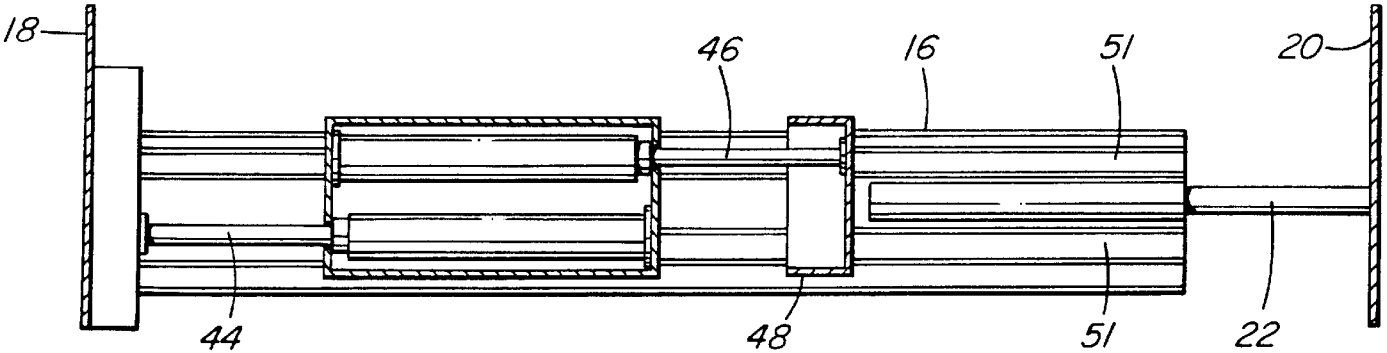
FIG. 5 is a sectional side view along the lines V—V in FIG. 3.
Figure 6:
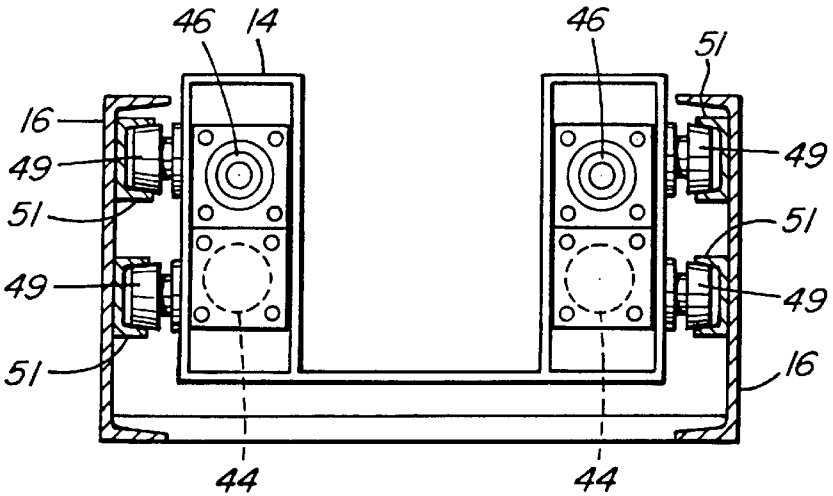
FIG. 6 is a cross-sectional view showing details of the travelling carriage and travelling guides of the apparatus of FIG. 2.

When the unit 10 is used in a pipe installation operation, the drive unit assembly 50 with the motor 52 is removed and the slip bowl and spinner assemblies 38, 42 are in place, as shown in FIG. 4. When in this mode, the unit 10 operates as described in U.S. Pat. No. 5,205,671, the entire contents of which is incorporated herein by reference and wherein the slip bowl and spinner assemblies are also described.

In the pipe installation mode (FIG. 4), the travelling drive unit mounting plate 48 is locked to the travelling carriage 14 for movement therewith and hydraulic cylinders 46 are inoperative. In this mode, the hydraulic cylinders 44 are operative in providing the pulling or pushing force for the pipe replacement operation. In this case, the control panel 54 is mounted on the side of the unit 10, as shown. The fork 34 is locked in an open position in which the fork 34 is in a raised position away from the rod 30 passing through the wiper plate 26, as shown in FIGS. 7A and B.

The operation of the unit 10 in the directional boring made (FIG. 3) will now be described. In this mode, the control panel is conveniently set up outside the machine pit in which the unit 10 is located.

Figure 20A:
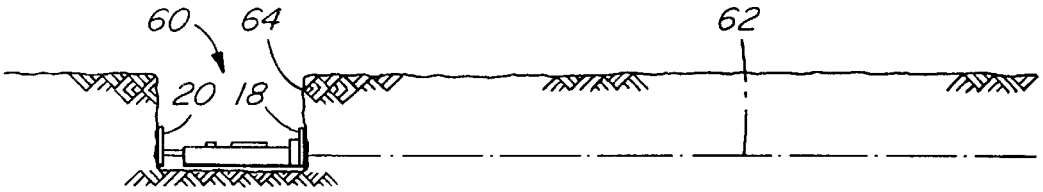
FIGS. 20A and B are, respectively, side and plan views of a directional boring operation along a straight path.
Figure 20B:
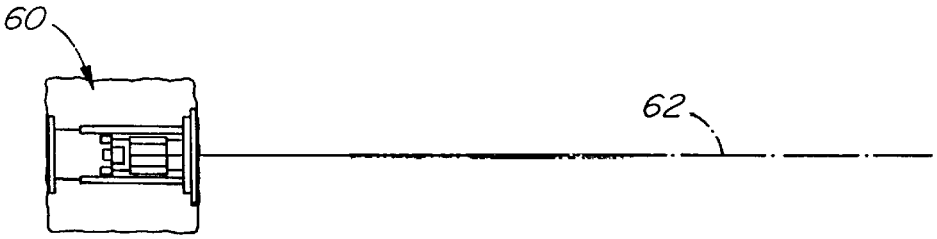

In order to effect a drilling operation, a machine pit 60 is dug either at one end of the intended path 62 or at a location along the intended path 62, e.g. at the centre of the intended path 62 (FIGS. 20A and B). As shown, the pit 60 is rectangular in cross section and has at least one pair of opposed vertical walls 64 for the engagement of the front plate 18 and the rear plate 20, respectively, therewith.

The unit 10 is set up in the pit 60 in a position in which it is lined up with the intended path 62 at the desired depth. To locate the unit 10 securely in the pit, the rear plate 20 is extended until it is pressed against the one pit wall 64 and locked. This locks the unit 10 in position between the walls 64.

In the drilling operation, a plurality of drive rods 30 are used. The rods 30 have screw threaded male and female members 66 at their opposite ends so that the rods 30 can be screwed together in series to form a drive connection or stem 30 between the motor 52 and a drill 68. The drill 68 is of a commercially available type having a cutting head and tracking beacon and will not be described further herein.

The motor 52 is provided with a screw-threaded male connection member 70 for screwing into a female end of a rod 30.

In order to install a rod 30, the cylinders 44 and 46 are extended to their full length which moves the motor 52 away from the front plate 18 and the fork 34, sufficiently for a rod 30 to be received between the fork 34 and the motor 52. With the one end of the rod 30 locked in against rotation, the rod 30 can be screwed onto the connection member 70 of the drive unit 52. The drill 68 is screwed onto the opposite end of the rod 30.

The rod 30 is released from the fork 34 and drilling is commenced by rotation of the rod 30.

The motor 52 is slowly advanced by retraction of the cylinders 46 and 44 as drilling progresses. When the rod 30 reaches the end of its travel, it is unscrewed from the motor 52, the motor 52 is retracted by expansion of the hydraulic cylinders 44 and 46. A new rod 30 is now screwed onto the motor 52 and by locking the first rod 30 with the fork 34, the new rod 30 is screwed onto the first rod 30 by means of the motor 52. Drilling is then continued by releasing the new rod 30 from the fork 34, rotating the rods 30 with the motor 52, while the motor 52 is slowly advanced by means of the hydraulic cylinders 44 and 46. To assemble further rods 30 as drilling progresses, the above procedure is repeated.

Figure 19:
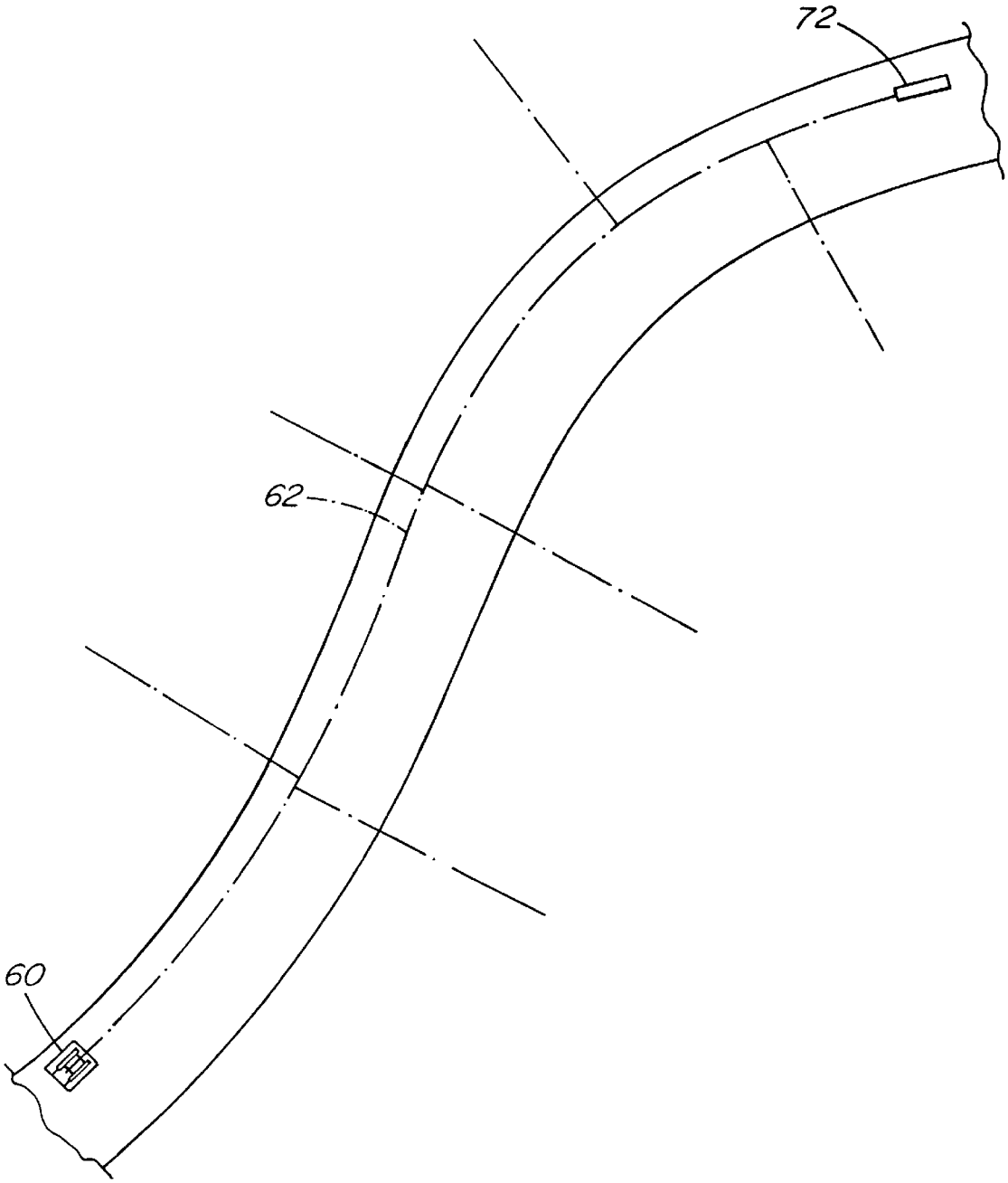
FIG. 19 is a plan view showing a directional boring operation along a curved path.

During the drilling operation, the drive rods 30 can be steered either in a straight line, as shown in FIGS. 20A and B, or in a curved line, as shown in FIG. 19, by making use of the cutting head and tracking beacon.

A pipe insertion pit 72 is dug at the opposite end of the intended drilling path 62, which pit 72 can be smaller than the machine pit 60, as shown in FIG. 19.

Figure 14:
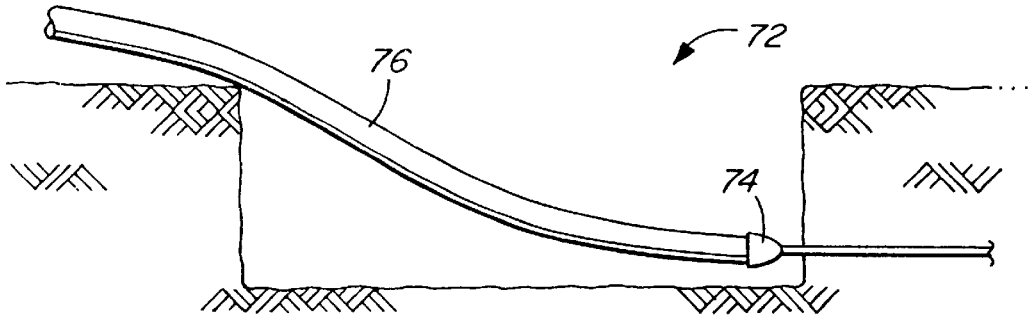
Figure 15:
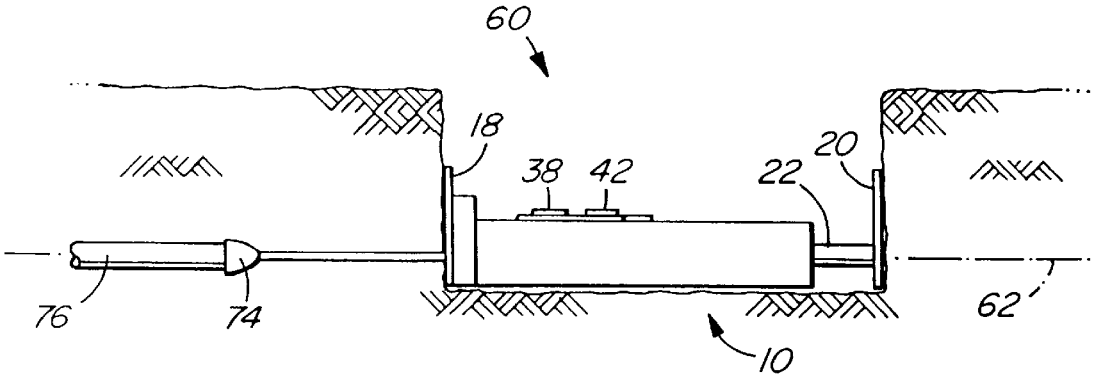

When the drill 68 reaches the pipe insertion pit 72, the drill 68 is removed and a pipe insertion member in the form of a pull-back head or back reamer head 74 is screwed onto the end of the rod 30 from which the drill 68 has been removed. The head 74 is in the form of a conical member with the end of a new pipe 76 to be installed attached to its wide end. As shown in FIGS. 14 and 15, the wide end of the head 74 has a greater diameter than the pipe 76 to protect the pipe 74.

The unit 10 is now converted to the pipe insertion or pulling mode (FIG. 4) by removing the drive unit assembly 50, locking the plate 48 to the carriage 14 and installing the slip bowl and spinner assemblies 38, 42.

The connecting string of rods 30 is then pulled back to pull the head 74 with the trailing pipe 76 along the passage drilled by the drill 68 in the immediately preceding operation.

The drilled passage is smaller than the pipe 76 and the head 74 enlarges the passage as it progresses along the passage to fit the new pipe 74. As the pulling operation progresses, the rods 30 are progressively unscrewed from the string of rods 30 by means of the spinner assembly, as described in U.S. Pat. No. 5,205,671.

Figure 16:
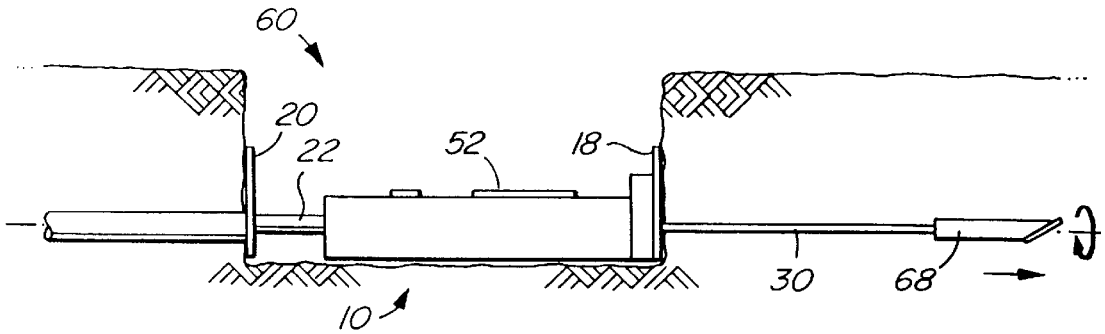
Figure 17:
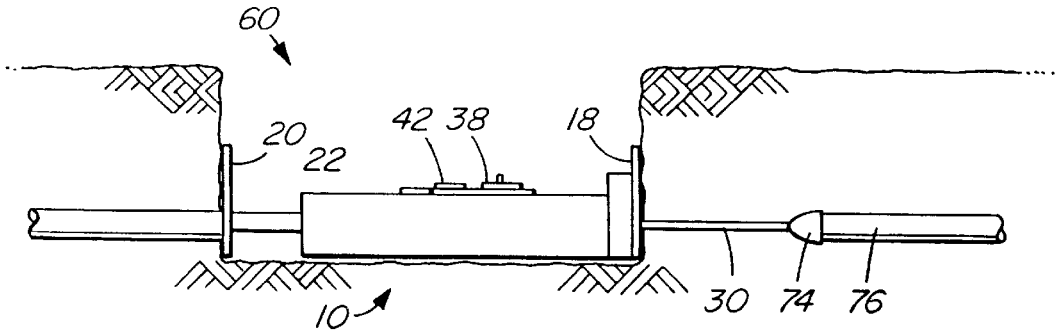
Figure 18:
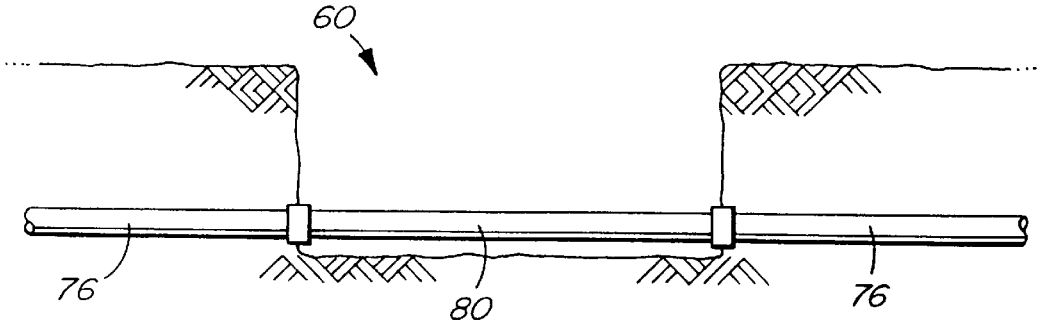

When the pipe 76 has been installed, the unit 10 can be turned around in the pit 60 and converted back into the directional boring mode, so that boring can now take place in the opposite direction, as shown in FIG. 16, and a pipe installed, as shown in FIG. 17. The operation is then completed by installing a tie-in section of pipe 80 to connect the opposite ends of the newly installed pipe 76, as shown in FIG. 18, in order to complete the pipeline.

While only preferred embodiments of the invention have been described herein in detail, the invention is not limited thereby and modifications can be made within the scope of the attached claims.

What is claimed is:

1. A utility power unit for performing underground drilling and pipe laying operations, comprising:

a stationary frame portion;

a movable frame portion capable of performing sliding movement relative to said stationary frame portion between a pair of limiting positions;

hydraulic cylinder means between said stationary and said movable frame portions for effecting movement of said movable frame portion between said limiting positions;

tool connection means associated with the movable frame portion and including first attachment means on the movable frame portion for removably attaching the tool connection means to the movable frame portion; and a rotary drive unit for an underground boring device associated with the movable frame portion and including second attachment means on the movable frame portion for removably attaching the rotary drive unit to the movable frame portion;

the tool connection means and the rotary drive unit being interchangeable with respect to each other, whereby either the one or the other is removably attached to the movable frame portion during operation of the power unit.

2. The power unit according to claim 1, wherein said connection means comprises a slip bowl or bushing for a set of slips.

3. The power unit according to claim 1, wherein said hydraulic cylinder means comprises a number of hydraulic cylinders which are symmetrically arranged with respect to said tool connection means.

4. The power unit according to claim 1, wherein said rotary drive unit comprises a hydraulic motor.

5. The power unit according to claim 1, wherein said movable frame portion has a secondary portion movable relative to the movable frame portion and wherein said second attachment means is located on said secondary portion.

6. The power unit according to claim 5, further comprising hydraulic cylinder means between said movable frame portion and said secondary portion for effecting movement of said secondary portion relative to said movable frame portion.

7. The power unit according to claim 6, wherein said hydraulic cylinder means comprises a number of hydraulic cylinders which are symmetrically arranged with respect to said drive unit.

8. The power unit according to claim 1, further comprising gripping and rotary means associated with said movable frame portion for gripping and rotating a stem to effect assembly of said stem from individual screw-threaded stem portions or disassembly of the stem into said individual stem portions and third attachment means on the movable frame portion for removably attaching said gripping and rotating means to said movable frame portion.

9. The power unit according to claim 8, wherein said gripping and rotating means comprises a number of opposing members for gripping a stem therebetween and including means on the opposing members for rotating the stem when engaged by said opposing members.

10. The power unit according to claim 1, further comprising stem locking means on said stationary frame portion for locking a stem against rotation about the longitudinal axis of the stem.

11. The power unit according to claim 1, wherein said stationary frame portion has a front plate which is provided with a stem wiper plate for receiving a stem therethrough and including means on the wiper plate for wiping dirt or debris from the stem during longitudinal movement of the stem through said wiper plate.

12. The power unit according to claim 1, wherein said movable frame portion has an extendable rear plate and including means for locking the rear plate in an extended position relative to said stationary frame portion to secure the stationary frame portion in position between a pair of opposite vertical walls of a pit in the ground.

13. A method of directional boring along an intended underground path, comprising the steps of:

providing a machine pit at a location along the intended path;

drilling a bore along said intended path by means of directional drilling means which includes a stem provided with a drill bit at a forward end thereof, said bore starting from an inside wall of said pit at a location beneath ground surface;

providing a pipe insertion pit along said intended path remote from said machine pit;

drilling said bore up to said pipe insertion pit and through an inside wall of said pipe insertion pit;

replacing said drill bit with a pipe insertion tool on the end of said stem;

attaching a pipe to said pipe insertion tool;

pulling said pipe insertion tool and said pipe from said pipe insertion pit to said machine pit;

replacing said pipe insertion tool with a drill bit on the end of said stem;

drilling a bore in an opposite direction along said intended path, said bore starting from an opposite inside wall of said machine pit;

providing a second pipe insertion pit along said intended path remote from said machine pit;

drilling said opposite bore up to said second pipe insertion pit and through an inside wall of said second pit;

replacing said drill bit with a pipe insertion tool on the end of said stem;

attaching a second pipe to said pipe insertion tool;

pulling said pipe insertion tool and said second pipe from said second pit to said machine pit; and connecting the ends of said pipe and said second pipe by means of a third pipe extending between the opposite walls of the machine pit.

* * * * *